US010815033B2

(12) United States Patent
Hanssen et al.

(10) Patent No.: US 10,815,033 B2
(45) Date of Patent: Oct. 27, 2020

(54) CONTAINER FOR LIQUIDS

(76) Inventors: Hubert Joseph Frans Hanssen, Amsterdam (NL); Jan Dirk Veendendaal, Den Helder (NL); Jan Veendendaal, Den Helder (NL)

( * ) Notice: Subject to any disclaimer, the term of this patent is extended or adjusted under 35 U.S.C. 154(b) by 57 days.

(21) Appl. No.: 13/643,610

(22) PCT Filed: Apr. 26, 2011

(86) PCT No.: PCT/EP2011/056553

§ 371 (c)(1),
(2), (4) Date: Feb. 14, 2013

(87) PCT Pub. No.: WO2011/134949

PCT Pub. Date: Nov. 3, 2011

(65) Prior Publication Data

US 2013/0200100 A1 Aug. 8, 2013

(30) Foreign Application Priority Data

Apr. 27, 2010 (EP) ..... 10161157
Nov. 9, 2010 (EP) ..... 10190570

(51) Int. Cl.

| | |
|---|---|
| ***B65D 33/00*** | (2006.01) |
| ***B65D 8/00*** | (2006.01) |
| ***B65D 77/06*** | (2006.01) |
| ***B67C 3/32*** | (2006.01) |
| ***B65D 77/04*** | (2006.01) |

(52) U.S. Cl.

CPC ..... *B65D 33/00* (2013.01); *B65D 11/06* (2013.01); *B65D 77/0486* (2013.01); *B65D 77/06* (2013.01); *B67C 3/32* (2013.01)

(58) Field of Classification Search

CPC ..... B65D 35/28; B65D 35/56; B65D 35/00; B65D 83/00; B65D 33/00; B65D 11/06; B65D 77/06; B65D 77/0486; B65D 83/384; B65D 83/44; B65D 83/62; B67D 7/60; B67C 3/32

USPC ..... 222/95, 105, 107, 386.5, 399, 183; 141/2, 5, 7, 39; 220/592.19

See application file for complete search history.

(56) References Cited

U.S. PATENT DOCUMENTS 4,242,884 A * 1/1981 Kotschwar ..... F25D 3/08 220/592.19
4,378,069 A * 3/1983 Franco ..... 383/207
4,387,833 A * 6/1983 Venus, Jr. ..... B65D 83/0061 222/95

(Continued)

FOREIGN PATENT DOCUMENTS

EP 0389191 A1 9/1990
EP 0862535 10/1999

(Continued)

OTHER PUBLICATIONS

Chilean examination report dated Apr. 2, 2014.

(Continued)

*Primary Examiner* — Paul R Durand
*Assistant Examiner* — Andrew P Bainbridge

(57) ABSTRACT

A container for liquids, such as beverages and oils, may include a blow moulded polyester casing, a valve for dispensing the liquid from the container, and an inlet for introducing a propellant. The casing may be enveloped by a stretch blow moulded polyester shell.

27 Claims, 4 Drawing Sheets

(56) References Cited

U.S. PATENT DOCUMENTS 4,458,830 A * 7/1984 Werding ..... B65D 83/0055 222/131
4,491,247 A * 1/1985 Nitchman ..... B65D 77/06 220/586
4,531,656 A * 7/1985 Nitchman ..... B65D 77/06 215/12.1
4,678,101 A * 7/1987 Nitchman et al. ..... 222/82
4,867,348 A * 9/1989 Dorfman ..... B65D 83/14 222/173
4,969,577 A * 11/1990 Werding ..... B65D 83/14 141/3
5,090,095 A * 2/1992 Lightfoot ..... 24/306
5,129,534 A * 7/1992 Dunn ..... B65D 11/06 220/4.11
5,238,150 A * 8/1993 Williams ..... 222/95
5,301,838 A * 4/1994 Schmidt ..... B67D 1/0462 222/105
5,368,195 A * 11/1994 Pleet ..... B67D 7/0255 222/105
5,613,622 A * 3/1997 Surrena ..... B65D 90/046 220/23.87
5,730,328 A * 3/1998 Maeder ..... B65D 83/62 222/464.2
5,927,551 A * 7/1999 Taylor ..... B65D 83/0061 222/105
6,354,473 B1 * 3/2002 Brambach ..... B65D 47/247 141/349
6,375,048 B1 * 4/2002 van der Meer ..... B67D 1/0462 222/105
6,601,732 B1 * 8/2003 Rooney et al. ..... 222/107
6,666,358 B1 * 12/2003 Field ..... B65D 11/06 222/400.7
7,455,195 B2 * 11/2008 Mekata ..... B05B 11/3081 222/94
7,597,124 B2 * 10/2009 Litto ..... 141/285
7,820,257 B2 * 10/2010 Kjorlaug et al. ..... 428/35.7
8,074,847 B2 * 12/2011 Smith ..... B65D 83/38 222/394
8,348,086 B2 * 1/2013 Apps ..... B65D 77/0486 220/592.19
8,371,469 B2 * 2/2013 Takedutsumi ..... B65D 77/06 220/495.03
8,763,825 B2 * 7/2014 Wauters ..... B65D 1/16 206/503
8,844,774 B2 * 9/2014 Leys ..... B65D 83/0055 222/105
8,851,322 B2 * 10/2014 Landman ..... B29C 49/4252 220/610
8,857,661 B2 * 10/2014 Maas ..... B65D 83/0055 222/1
8,939,215 B2 * 1/2015 McMiles ..... 166/344
2003/0106874 A1 * 6/2003 White ..... B29C 49/0073 215/317
2006/0237486 A1 * 10/2006 Kersten ..... 222/386.5
2006/0257603 A1 * 11/2006 Shi ..... B29B 11/14 428/35.7
2008/0110928 A1 * 5/2008 Veenendaal ..... B65D 77/0426 222/105
2008/0247684 A1 * 10/2008 Binks et al. ..... 383/113
2008/0257846 A1 10/2008 Hove et al.
2008/0272145 A1 * 11/2008 Nimmo ..... B65D 83/62 222/95
2009/0045222 A1 * 2/2009 Nimmo ..... B65D 83/62 222/95
2009/0145924 A1 * 6/2009 Fiedler ..... B67D 7/0255 222/95
2010/0077790 A1 * 4/2010 Apps ..... B65D 77/0486 62/372
2010/0089488 A1 4/2010 Veenendaal et al.
2011/0108574 A1 * 5/2011 Nimmo ..... B65D 83/38 222/95
2012/0181289 A1 * 7/2012 Apps ..... B65D 11/08 220/592.19
2012/0187067 A1 * 7/2012 Maas ..... B29C 49/06 215/12.1
2013/0200100 A1 * 8/2013 Hanssen ..... B65D 77/0486 222/95
2014/0231427 A1 * 8/2014 Botet ..... B65D 25/18 220/62.21
2016/0185505 A1 * 6/2016 Van Hove ..... B29B 11/14 222/1
2016/0200562 A1 * 7/2016 Hanssen ..... B67D 7/0266 222/183
2018/0222657 A1 * 8/2018 Rundin ..... B65D 11/06

FOREIGN PATENT DOCUMENTS

EP 1736421 12/2006
EP 1880824 A1 1/2008
FR 1412075 A 9/1965
JP 1134152 A 2/1999
JP 2000232297 8/2000
JP 4150595 B2 7/2008
WO 00/07902 2/2000
WO 00/78655 A1 12/2000
WO 00/78665 A1 12/2000
WO 2008/000574 A1 1/2008
WO WO 2009021976 A1 * 2/2009 ..... B65B 31/003
WO WO-2011134949 A1 11/2011

OTHER PUBLICATIONS

Patent Examination Report in corresponding Australian application 2011246532, dated May 23, 2014, 4 pages.
Corresponding JP office action dated Feb. 2, 2016.
International Search Report for PCT/EP201/056553, ISA/EP, Rijswijk, NL, dated Aug. 2, 2011.
Ukranian Office Action dated Apr. 29, 2016, corresponding to application No. UK 2012/12284 filed Apr. 26, 2011. English translation.
Corresponding Korean office action dated Feb. 10, 2017.
India Patent Office Examination Report dated Jul. 24, 2018.

* cited by examiner

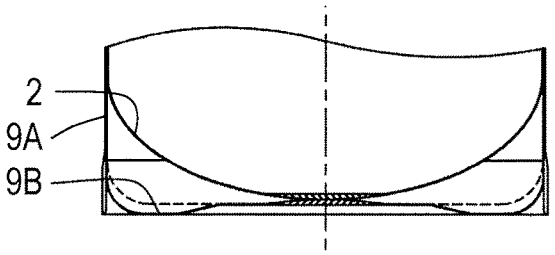
Fig.5A
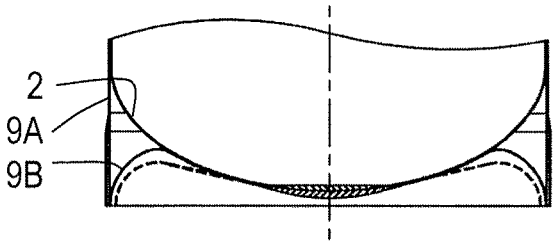
Fig.6A
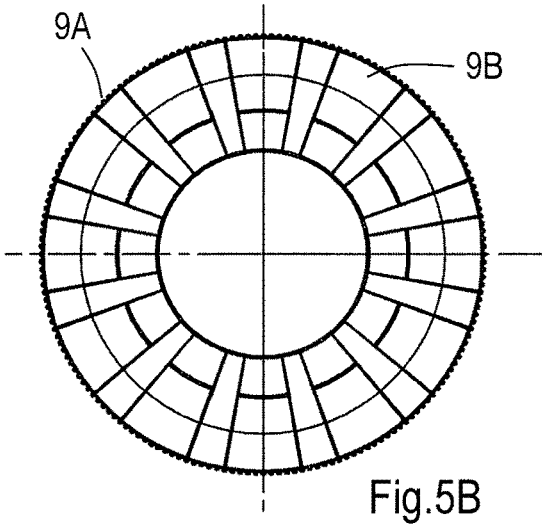
Fig.5B
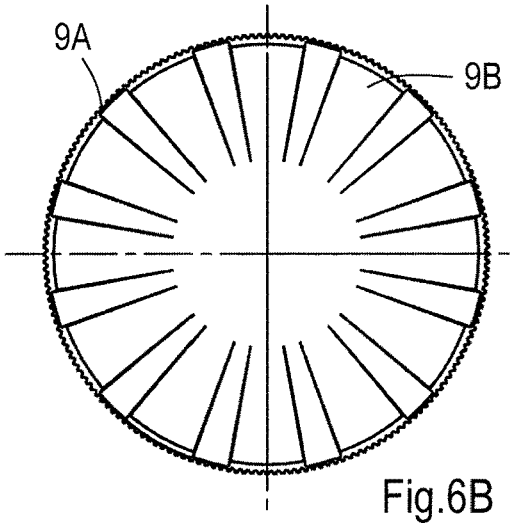
Fig.6B
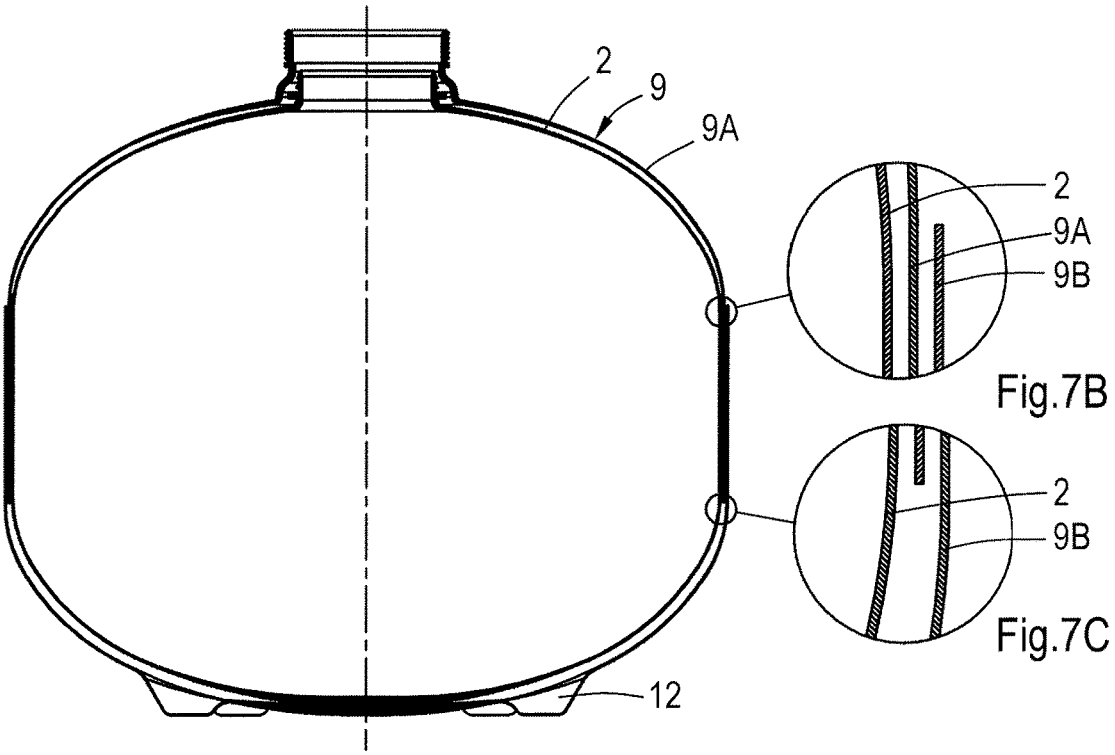
Fig.7B
Fig.7C
Fig.7A

CONTAINER FOR LIQUIDS

CROSS-REFERENCE TO RELATED APPLICATIONS

This application is a 371 U.S. National Stage of International Application No. PCT/EP2011/056553, filed Apr. 26, 2011. This application claims the benefit of European Patent Applications No. 10161157.2, filed Apr. 27, 2010 and Ser. No. 10/190,579.1, filed Nov. 9, 2010. The disclosures of the above applications are incorporated herein by reference.

The invention relates to a container for liquids, such as beverages, e.g. beer, soft drink and wine, and liquids with a relatively high viscosity, e.g. edible oil, comprising a blow moulded polyester and preferably spherical or spheroid casing, a valve for dispensing the liquid from the container, and an inlet for introducing a propellant, which inlet is typically integrated in the valve.

EP 862 535 relates to a container for fluids comprising an outer and preferably ellipsoid casing of a flexible, pressure resistant material, a gastight inner casing of flexible material located inside the outer casing, and a filling connection for filling the inner casing.

EP 1 736 421 relates to a lightweight container for fluids, in particular liquids, such as beer or water, comprising a spherical or spheroid casing, a valve part for filling the container with a fluid and an outer package typically made of cardboard surrounding the casing. A similar lightweight container is known from EP 2 038 187. In an embodiment, the casing is made of blow moulded PET.

Many containers for liquids are subjected during use to high internal pressures. E.g., beverages containing a gas should be maintained at an elevated pressure, typically in a range from 1 to 4 bar (overpressure), to prevent the gas from escaping the beverage. Also, liquids having a relatively high viscosity and liquids that are dispensed from a lower level, e.g. from a cellar, require a relatively high pressure in the container to overcome friction and hydrostatic pressure, respectively. High temperatures and non-observance of safety guidelines can also lead to high internal pressures.

During dispensing, the liquid content of the container is gradually replaced by pressurized gas. Pressurized gas has a high energy content, which means that if the container is cut, punctured or otherwise damaged and fails, it will burst in an explosive manner. Explosive bursting may result in shrapnel and injury, e.g. damaged hearing of people close by.

In practice, explosive bursting occurs when the container has been installed for dispensing, e.g. through contact with cigarettes, hot air outlets of coolers or sharps behind the bar or stress cracking resulting from exposure to aggressive (caustic) cleaning agents. Explosive bursting also occurs when users want to dispose of an empty container and—disregarding safety guidelines—cut or stab the container with a knife or other implement.

It is an object of the present invention to provide a container that is relatively lightweight and yet more resistant to explosive bursting.

To this end, the container according to the invention is characterized in that the casing is enveloped by a stretch blow moulded polyester shell. In an embodiment, the shell supports the casing at least when the latter is pressurized, e.g. the internal pressure urges the casing against the shell.

The stretch blow moulded polyester shell was found to provide a relatively high retained strength of the container after the shell and casing have been cut, punctured or otherwise damaged, thus raising the threshold pressure at which the container explodes. Below this threshold, the pressurized gas inside the casing will typically blow off rather than causing the container to explode. In addition, the shell enables a design that is lighter than containers having a cardboard or e.g. HDPE shell and/or increases design freedom especially with regard to external features, e.g. a stable base as will be explained in more detail below.

In an embodiment, the burst strength of the container is at least 20%, preferably at least 30% higher than the burst strength of just the casing. Burst strength is defined as the pressure, in bar, at which the container respectively the casing bursts, when at 20° C. and when the pressure is gradually increased with 1 bar per 10 seconds.

In a further embodiment, the relative expansion of the container, when exposed to 5 bar internal pressure and 40° C. during 2 days, is less than 3%, preferably less than 2%, more preferably less than 1.5% higher than the expansion of an identical container exposed to 2 bar internal pressure and 20° C. during 2 days. Low expansion is especially relevant for liquids containing a gas with low solubility. Nitrogen ($N_2$), for instance, has a poor solubility in water and thus only a small amount of nitrogen can be added to beer. When the volume of the container increases permanently by only a small percentage, e.g. due to creep at elevated temperatures, a large percentage of the nitrogen will escape from the beer and taste, texture, and dispensing behavior of the beer will deteriorate. This phenomenon can be reduced with the shell according to the present invention.

In an embodiment, which, incidentally, is also useful in containers comprising casings and shells made of other polymers, the shell comprises two separate parts, e.g. divided along a circumference of the shell, and at least one of the parts, preferably the top part, is clamp fitted on the casing when the latter is pressurized. The shell can be blow moulded from a preform and additional means, such as a lid, necessary for inserting the casing into the shell and subsequently closing the shell may be avoided. In this context, clamp fitted implies that a force of at least 300 N, preferably at least 500 N in axial direction is required to separate the parts of the shell from the casing. I.e., when lifting a container holding twenty liters, or thirty or fifty liters as the case may be, of a beverage by the shell, the casing will not slide with respect to the shell.

The remaining part of the shell can be secured, e.g. by clamping, glueing and/or welding, in the bottom side of the part clamp fitted on the casing.

In an embodiment, the two parts overlap, preferably by at least 1 centimeter, more preferably by at least 5 centimeters. This overlap may extend e.g. over the whole cylindrical section of the container resulting in a three layered structure in this part of the container.

Instead of the remaining part of the shell, a separately formed foot, optionally made of a different material, can be secured in the shell and/or to the casing.

In a further embodiment, the rim of one part of the shell overlaps the rim of the other part of the shell. In a further embodiment, the parts of the shell are glued or taped to the casing.

The stretch blow moulded shell suppresses or prevents explosive bursting even in elongate containers, e.g. containers having a relatively high length to width ratio (L/D) and/or a relatively long cylindrical portion. Such shapes facilitate logistics, e.g. more containers can be placed on a pallet, and facilitate cooling, e.g. four containers fit in a standard size refrigerator. In an embodiment, the casing has an internal volume of at least 10, preferably at least 15, more preferably at least 20 liters and the length to width ratio (L/D) of the casing is in excess of 1.5, preferably in excess of 2. In another embodiment, the container comprises a cylindrical portion that extends over at least 25%, preferably at least 40%, more preferably at least 50% of the height of the container.

In an embodiment, the wall thickness of both the casing and the shell is in a range from 0.1 to 1.0 mm, preferably in a range from 0.3 to 0.6 mm, providing a total wall thickness of up to 2.0 mm, and, e.g. if parts of the shell overlap each other, locally even up to 3.0 mm, which currently cannot be achieved by blowing a single preform.

Puncture resistance is further improved if the shell is embossed about its circumference so as to increase the actual or at least the effective thickness in the radial direction. Also, embossing reduces the risk of damage to the container when the container is rolled over a rough surface e.g. from a truck to storage.

In a further embodiment, the container is filled with a pressurized gas and no beverage, i.e. the container is pressurized prior to filling, e.g. with air or carbon dioxide and/or nitrogen at a pressure in excess of 1.5 bar. Thus, the container can be readily filled with a liquid containing a gas, such as beer.

WO 00/78665 relates to a beer container comprising an inner hollow shell of blow moulded PET to hold beer, an outer hollow shell of molded high density polyethylene (HDPE) enclosing and supporting the inner shell and a spear structure including a dispenser tube extending from a bottom interior region of the inner shell through to a dispensing outlet at the top of the outer shell. When the container has been emptied of beer, the outer shell can readily be separated from the inner shell and spear structure to allow separate recycling of the HDPE and the PET. A 30 liter keg of this type typically weighs about three kilograms. Further, extrusion blow moulded HDPE is inferior when it comes to preventing explosive bursting of containers holding a gas at higher pressures.

US 2010/0077790 relates to a plastic beer keg includes an outer container and an inner liner. A removable lid is secured over an opening to the container to enclose the liner. In use, the lid can be removed and ice placed in the container directly on the liner, ice flows into gaps between the liner and the container to provide rapid cooling of the content of the liner. The liner may be PET, the container and lid may be HDPE, polypropylene or another suitable material.

EP 389 191 relates to a container for transport, storage and dispensing of beverages, such as beer, comprising an outer container (12) of plastics such as PET, and an inner bag (20) of flexible material, such as layered polyethylene.

Within the framework of the present invention "stretch blow moulding" refers to blow moulding and thus stretching a preform, in both the circumferential (hoop) direction and the axial direction.

The term "spheroid" includes any shape generated by a half-revolution of a circle or a square or rectangle with rounded corners or an ellipse or oval about its major axis or minor axis.

The invention will now be explained in more detail with reference to the drawings, which show a preferred embodiment of the present invention.

Figure 1A:
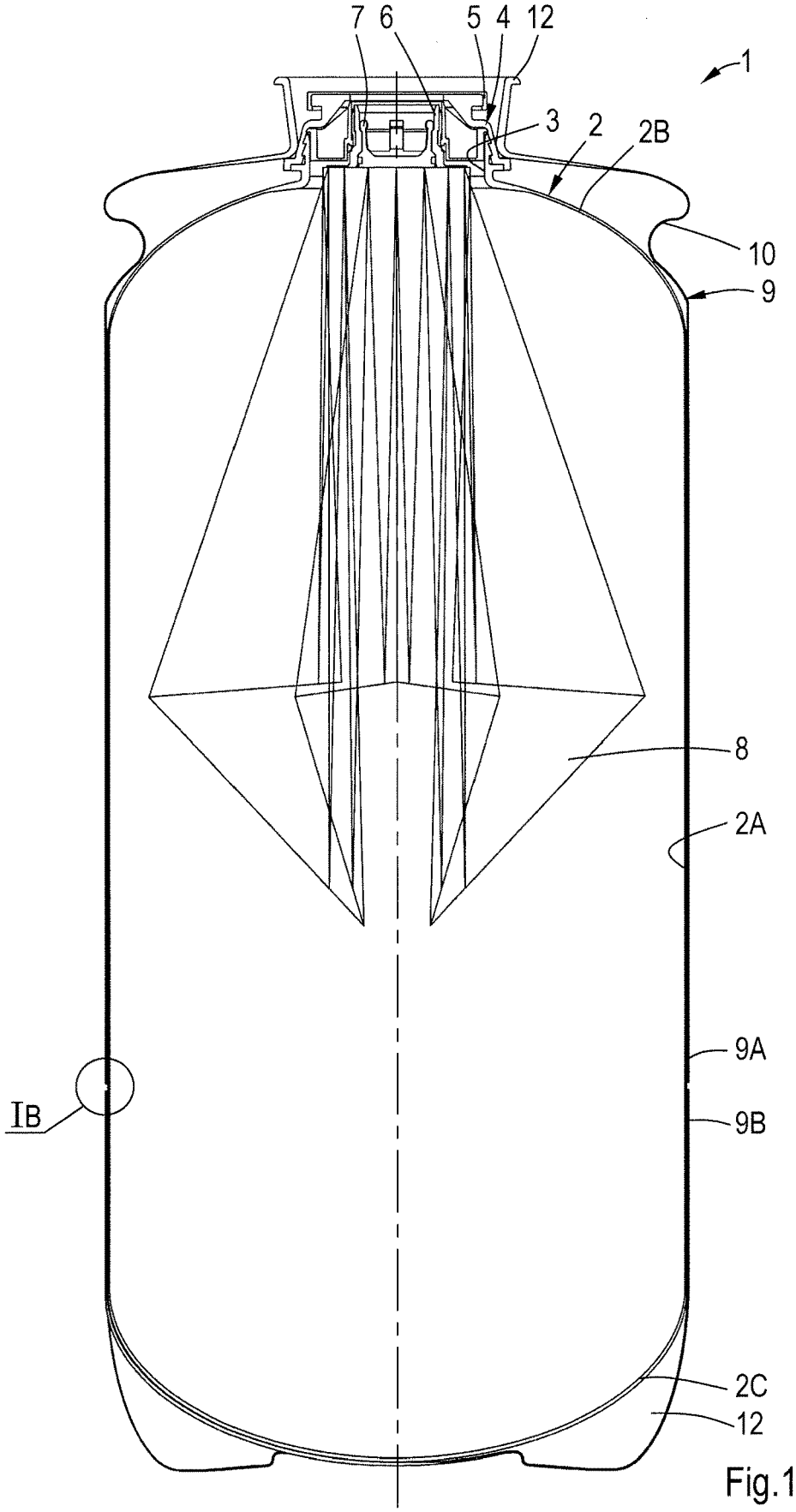
FIGS. 1A and 1B show a cross-section through and a detail of a container according to the present invention.

FIGS. 5A/5B and 6A/6B show cross-sections and bottom views of containers according to the present invention with a base providing enhanced stability.

FIGS. 7A to 7C show cross-sections of a container according to the present invention comprising a cylindrical portion with increased wall thickness.

The drawings are not necessarily to scale and details, which are not necessary for understanding the present invention, may have been omitted. Further, elements that are at least substantially identical or that preform an at least substantially identical function are denoted by the same numeral.

FIG. 1 shows a container 1 for a beverage containing a gas, in particular beer, comprises a casing 2 made by stretch blow moulding a polyester preform, in particular PET (polyethylene terephthalate). The casing 2 comprises a substantially cylindrical middle portion 2A and top and bottom domes 2B, 2C. The top dome 2B has a central opening 3 formed by the non-deformed part of the preform.

A valve part 4 for dispensing the beverage from the container is snap-fitted to the opening 3. In this example, the valve part 4 comprises an outer jacket 5, an inner jacket 6 slidably received inside the outer jacket 6, and a closing element 7 which, in turn, is slidably received inside the inner jacket 6. The inner jacket and the closing element can be made of a polyolefin such as PE or PP. In general, it is preferred that the valve part is made of PA or PET, preferably in its entirety. For more details on this and other suitable valve parts reference is made to International patent application WO 00/07902 (see especially page 8, line 12 ff. in conjunction with FIGS. 4A and 4B).

In this example, a gastight bag 8 for receiving the beverage is connected to the valve part 4 and located inside the casing 2. The bag 8 comprises two, in this example polygonal, flexible sheets of a gas and liquid tight laminate, preferably a laminate comprising a sealing layer (e.g., PE or PP), a barrier layer (e.g. aluminum) and one or more further layers (e.g. PA and/or PET), sealed together along their edges, e.g. by means of welding. In general, the barrier function can be shared with or shifted to the casing rendering the casing impermeable to carbon dioxide, oxygen and/or nitrogen. To this end, the casing may comprise additives, a coating or a plurality of layers.

In accordance with the invention, the casing 2 is enveloped by a stretch blow moulded polyester shell 9. In the example shown in FIG. 1, the shell comprises two parts 9A, 9B, separated along a circumference, i.e. in hoop direction, of the shell 9. When pressurized, the casing 2 expands and firmly abuts the inner wall of the shell 9. Thus, the parts 9A, 9B are both clamp fitted on the casing 2.

The shell was blow moulded from a preform similar to that used for the casing but with a different rim. Also, in contrast to the casing, which preferably should have a smooth shape defined by a cylinder and two domes to withstand internal pressure and to avoid damage to the bag containing a beverage, the shell may be provided with one or more features providing additional functionality.

E.g., the shell may comprise one or more handles defined in, in particular, the top portion. Examples of such handles include a notch 10 spanning the circumference of the shell 9, as shown in FIGS. 1A, 3 and 4, or two grips on opposite sides of the shell or a radial flange 11 extending from the upper rim of the shell, as shown in FIG. 2.

Figure 2:
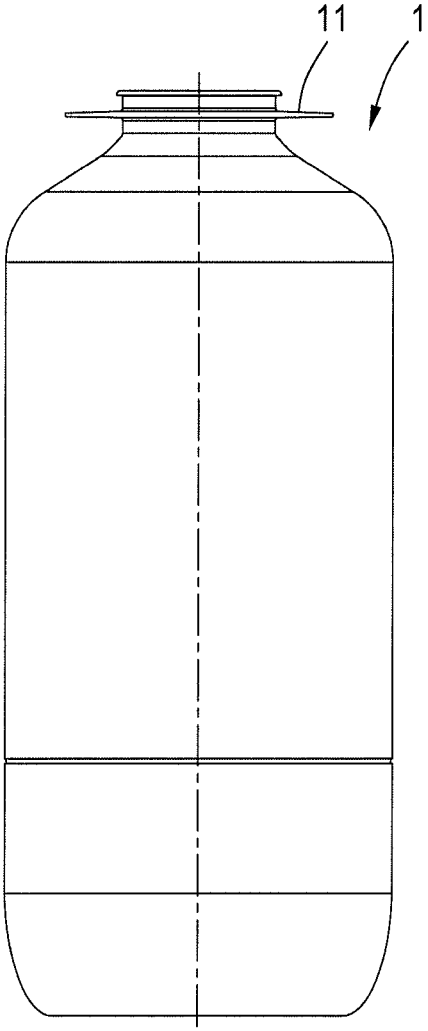
FIGS. 2 to 4 show a stack and variations of the container in FIGS. 1A and 1B.
Figure 3:
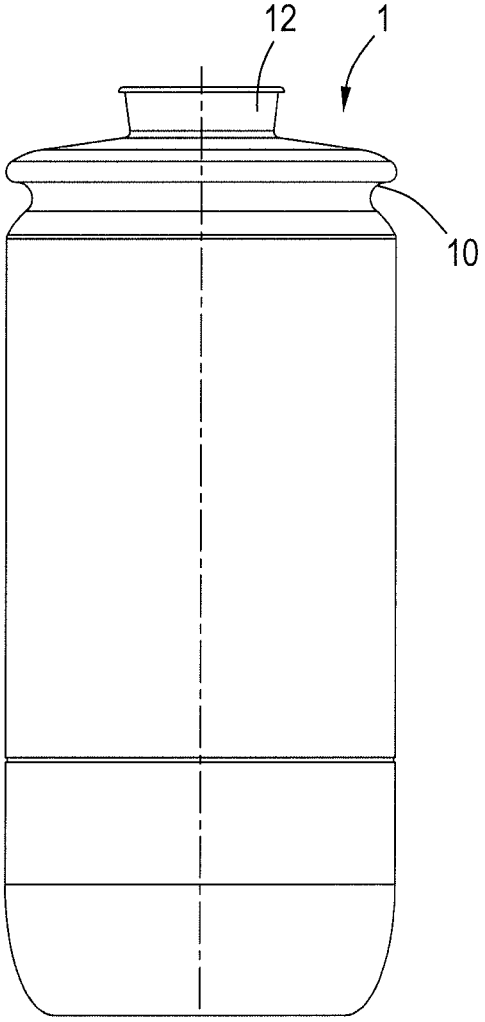
Figure 4:
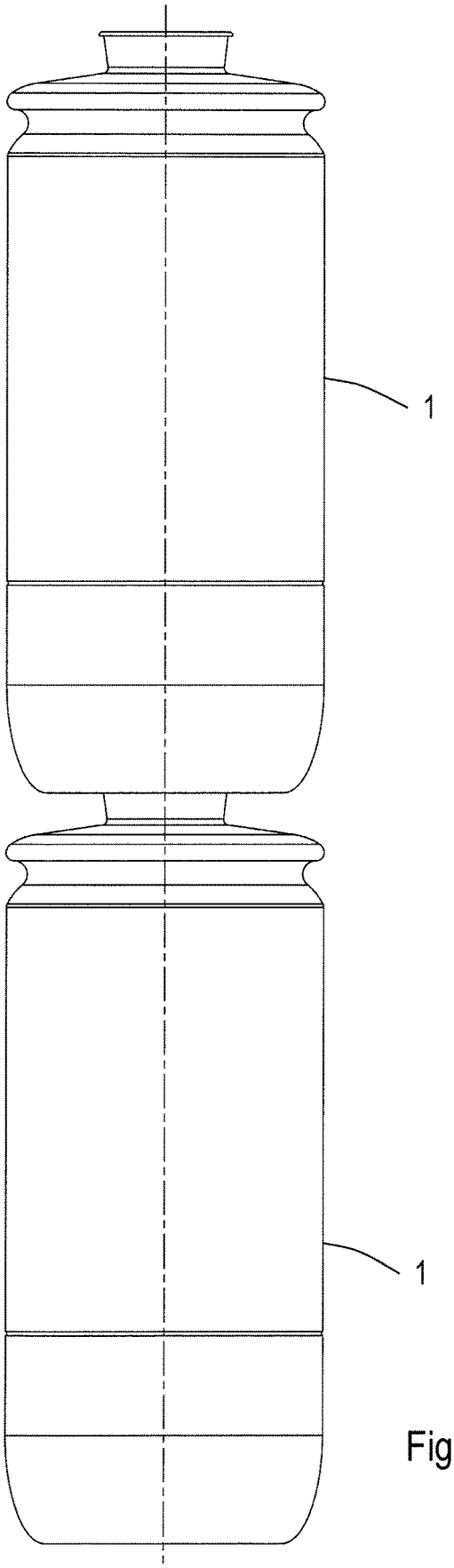

In the example shown in FIGS. 1A, 3 and 4, the top part 9A of the shell further comprises a collar 12 extending around the valve part and protecting the same.

The base 9B can be provided with features enabling a stable upright position of the container. In the example, the shell comprises a petaloid foot 12, similar to those employed in 1.5 liter bottles for soft drink. In addition to providing a stable base, the foot provides a crumble zone protecting the container when it falls.

Further, the top and base of the shell are preferably shaped to render the container stackable, as shown in FIG. 4. The base comprises a recess which is complementary to the collar or the lobs of the petaloid base define a (non-continuous) recess which corresponds to the collar.

The container has an overall length of approximately 57 cm and a width of approximately 24 cm, yielding an L/D of 2.4. The cylindrical portion has a length of approximately 65% of the overall length of the container.

Puncture resistance is further improved if the shell is embossed about its circumference so as to increases the actual or at least effective thickness in the radial direction. In general, embossing may comprises a large number of small protrusions on the outer surface of the shell, yielding e.g. a knurled surface, and/or may comprise a plurality of rings about the circumference of the container and/or a plurality of ribs extending in axial direction. Also, embossing may provide other, additional functions. In an embodiment, the shell comprises at least two rings extending about the circumference of the shell and spaced apart in axial direction. Such rings facilitate rolling the container e.g. from a truck to storage and reduce the risk of damage to the inner casing inflicted by small sharps on the surface.

FIGS. 5A and 5B show a further embodiment of the container according to the present invention. In this embodiment, the casing 2 is again enveloped by a stretch blow moulded polyester shell 9. The shell comprises two parts 9A, 9B, separated along a circumference, i.e. in hoop direction, of the shell 9, relatively close to the bottom of the shell, such that the top part of the shell is longer than the casing. As a result, the lower rim of the upper part of the shell extends beyond the bottom of the casing and serves as the foot or part of the foot of the container. To further increase stability, it is preferred that, at the rim, the wall is corrugated to increase its effective thickness and stiffness and/or the wall is actually thicker, preferably at least two times thicker, than the wall of the cylindrical section of the shell.

The base 9B can be discarded or be used to further increase the strength and stability of the foot. In this example, the base part is provided with creased and radially extending segments to enhance the stiffness of the base, in turn facilitating a stable upright position of the container, and to provide a crumble zone protecting the container when it falls. More specifically, the base part defines a petaloid foot 12 and is placed, e.g. pressed, inside the bottom end of the top part of the shell. The base part can be clamped, glued, and/or welded into the top part of the shell.

In the embodiment shown in FIGS. 6A and 6B, the base part was reversed before being inserted in the bottom end of the top part, thus significantly increasing, e.g. doubling, the wall thickness at the lower rim of the shell. The center of the base is shaped complementary to the bottom end of the casing, thus providing support over a relatively large area.

As is apparent from FIGS. 5B and 6B, the cross-section of the upper rim of the base part differs from that of the lower rim of the top part of the shell, both in diameter and in shape. Thus, the shell is preferably formed with a transition between the two parts 9A, 9B and these parts are each separated from the transition, e.g. by two (laser) cuts in the hoop direction of the shell 9.

Figure 1B:
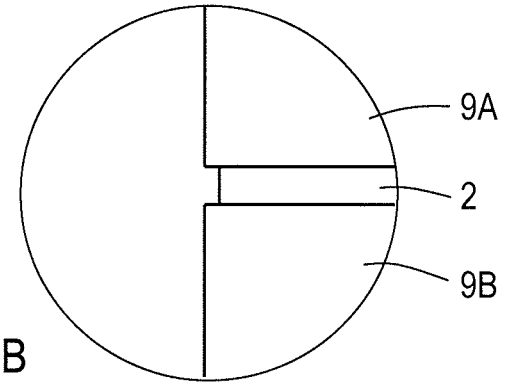

FIGS. 7A to 7C show a container according to the present invention which in most respects corresponds to the container shown in FIGS. 1A and 1B but with a casing 2 and shell 9 having an L/D of approximately 1 and a relatively short cylindrical section. The shell is considerably longer than the casing, preferably by a length that corresponds to the length of the cylindrical portion of the casing. In other words, the length of the cylindrical portion of the shell is twice the length of the cylindrical portion of the casing. When the shell is separated along a circumference, i.e. in hoop direction and preferably halfway the height of the shell 9, the casing is clamped inside the upper half and the upper half, now containing the casing, is clamped in the lower half, the wall thickness of the shell is doubled at the cylindrical portion.

Further, the container shown in FIGS. 7A to 7C comprises an external thread or annular protrusion about the top opening for screwing or snapping e.g. grips onto the container.

In the above examples, the shell was blow moulded from a preform similar to that used for the casing but with a different rim. Also, in contrast to the casing, which preferably should have a smooth shape defined by a cylinder and two domes to withstand internal pressure and to avoid damage to the bag containing a beverage, the shell may be provided with one or more features providing additional functionality.

The stretch blow moulded polyester shell was found to provide a relatively high retained strength of the container when the shell and casing are punctured, thus avoiding explosive bursting and enabling a more gradual blowing off of the pressurized gas inside the casing. In addition, the shell is resistant to water and enables a design that is lighter and stronger than containers having a cardboard shell. Due to the increased strength, the container according to the present invention is in principle suitable for beverages containing high concentrations of gas, e.g. 7 gram/liter carbon dioxide, at higher temperatures, e.g. 40° C.

Further, as both the casing and the shell are stretch blow moulded from a preform, logistics can be simplified e.g. by supplying just preforms and bags to brewers the containers can be mold blown and assembled on site, avoiding bulky transport.

The invention is not restricted to the above-described embodiments which can be varied in a number of ways within the scope of the claims. For instance, instead of a bag for containing the beverage, the container can be equipped with a spear extending from the valve part to the bottom of the casing.

The invention claimed is:

1. A container for liquids comprising:

a rigid blow moulded polyester casing defining an interior for receiving liquids and an exterior, a valve connected to the casing for dispensing the liquid from the container, the valve having an inlet for introducing a gaseous propellant into the interior of the casing, wherein the exterior of the casing is enveloped by a stretch blow moulded polyester shell such that upon pressurization of the interior of the casing, the exterior of the casing abuts the shell.

2. The container according to claim 1, wherein the shell supports the casing at least when the latter is pressurized.

3. The container according to claim 1, wherein the shell comprises two separate parts and at least one of the parts is clamp fitted on the casing when the latter is pressurized.

4. The container according to claim 3, wherein the remaining part is secured in the open end of the part that is clamp fitted on the casing.

5. The container according to claim 3, wherein the two parts overlap.

6. The container according to claim 5, wherein the two parts overlap by at least 1 centimeter.

7. The container according to claim 3, wherein the two separate parts of the shell are divided along a circumference of the shell.

8. The container according to claim 1, wherein the burst strength of the container is at least 20% higher than the burst strength of the casing.

9. The container according to claim 1, wherein the relative expansion of the container when exposed to 5 bar internal pressure and 40° C. during 2 days is less than 3%.

10. The container according to claim 1, wherein the casing has an internal volume of at least 10 liters and wherein the length to width ratio of the casing is in excess of 1.5 to 1.

11. The container according to claim 1, wherein the combined wall thickness of the casing and the shell is in excess of 0.8 mm.

12. The container according to claim 1, wherein the shell is embossed whereby the effective thickness of the shell is increased at the location of the embossment.

13. The container according to claim 1, comprising a liquid-tight inner container of a flexible material located inside the casing for containing the liquid and communicating with the valve.

14. The container according to claim 13, wherein the casing is impermeable to at least one of carbon dioxide, oxygen and nitrogen.

15. The container according to claim 1, wherein the casing is pre-filled with a pressurized gas.

16. The container according to claim 1, wherein the polyester of the casing and the shell is polyethylene terephthalate.

17. The container according to claim 1, wherein the casing and the shell are transparent.

18. The container according to claim 1, wherein the shell comprises at least one of a blow moulded handle and a blow moulded foot.

19. The container according to claim 1, wherein the burst strength of the container is at least 30% higher than the burst strength of the casing.

20. The container according to claim 1, wherein the relative expansion of the container when exposed to 5 bar internal pressure and 40° C. during 2 days is less than 2%.

21. The container according to claim 1, wherein the relative expansion of the container when exposed to 5 bar internal pressure and 40° C. during 2 days is less than 1.5%.

22. The container according to claim 1, wherein the casing has an internal volume of at least 10 liters and wherein the length to width ratio of the casing is in excess of 2 to 1.

23. The container according to claim 1, wherein the container comprises a cylindrical portion that extends over at least 25% of the height of the container.

24. The container according to claim 1, wherein the container comprises a cylindrical portion that extends over at least 40% of the height of the container.

25. The container according to claim 1, wherein the container comprises a cylindrical portion that extends over at least 50% of the height of the container.

26. The container according to claim 1, wherein the combined wall thickness of the casing and the shell is in excess of 1.0 mm.

27. The container according to claim 1, wherein the polyester of the casing and the shell are recycled polyethylene terephthalate.

* * * * *